US005405599A

United States Patent [19]

Porrovecchio

[11] Patent Number: 5,405,599

[45] Date of Patent: Apr. 11, 1995

[54] METHOD AND COMPOSITION FOR DETERRING CRIMINALS

[76] Inventor: Dennis J. Porrovecchio, P.O. Box 2198, Trinity, Tex. 75862

[21] Appl. No.: 199,584

[22] Filed: Feb. 22, 1994

[51] Int. Cl.[6] ..... A61K 31/275

[52] U.S. Cl. ..... 424/2; 222/1; 222/3; 424/10; 514/525; 514/673; 514/688; 514/706; 514/920

[58] Field of Search ..... 424/2; 514/920, 525, 514/706

[56] References Cited

U.S. PATENT DOCUMENTS 4,226,194 10/1980 Grahm ..... 109/25
4,816,260 3/1989 Wollrich ..... 424/463
4,895,273 1/1990 Bialy ..... 222/3

*Primary Examiner*—Allen J. Robinson
*Assistant Examiner*—Brian M. Burn
*Attorney, Agent, or Firm*—Neal J. Mosely

[57] ABSTRACT

A sprayable composition for deterring criminals, e.g., muggers, robbers, rapists, etc., consists essentially of a sprayable lachrymatory agent, such as MACE (chloroacetophenone) or orthochlorobenzyl-malononitrile dissolved in N,N-dimethyl formamide or N,N-dimethyl acetamide, or the like, admixed with a minor but effective amount of a dye which is substantive for human skin and difficult to remove and a minor but effective amount of a persistent odorant such as oil of skunk (a complex mercaptan), aliphatic diamines, such as putrescine (tetramethylene diamine) or cadaverine (pentamethylene diamine), or the like. The composition is supplied in a pressurized canister of the type conventionally used for containing and spraying MACE and when sprayed on an at-tacker repels the attacker and identifies him both by the stain and the smell.

8 Claims, No Drawings

METHOD AND COMPOSITION FOR DETERRING CRIMINALS

FIELD OF THE INVENTION

This invention relates to new and useful improvements in compositions and methods for repelling criminal attackers and more particularly to a composition and method of use which repels the attacker and identifies the attacker by both visual means and smell.

BRIEF DESCRIPTION OF THE PRIOR ART

Tear gas spray can effectively ward off a criminal attack but provides no means for identifying and aiding in the apprehension of the attacker.

Mauser U.S. Pat. No. 3,947,221 discloses an attachment for converting a standard camera flashbulb unit into a personal defense device for use against criminals. In one form of the attachment it can rotatably receive the bottom base post of the flashbulb unit and allow the various flash sections of a multiple-flash unit to be successively fired. In another form of the attachment it can be connected to the flash bulb unit for single triggering action.

Bialy U.S. Pat. No. 4,895,273 discloses a semiautomatic device for applying tear gas which includes a tear gas pressure vessel containing a compressed solution of tear gas agent disposed in a suitable solvent.

Potter U.S. Pat. No. 4,301,947 discloses the use of a tear gas to ward off a robbery attack and a device for improving the use and aiming of a tear gas canister.

Williamson U.S. Pat. No. 3,853,248 disclose a guard for spray valves.

Gaggini et al U.S. Pat. No. 4,044,684 discloses a projectile for dispensing an aerosol of lachrymating irritant material in which the aerosol material is ejected through a nozzle only after firing from a gun or weapon launcher and has imported within the target area. Safety means is provided to prevent premature discharge of the aerosol.

Fegley et al U.S. Pat. No. 3,967,757 discloses a chemical dispensing anti-burglary device in which a chemical irritant such as tear gas is discharged into the area to be protected when an intruder opens a window or opens a door or enters an unauthorized area with which the device is associated.

Helmrich U.S. Pat. No. 3,785,569 discloses an aerosol grenade which spins at a high rate about more than one axis to discharge its fluid contents over a wide area even under windless conditions. The grenade is especially useful as a means of distributing tear gas, the rapid and erratic movement preventing throw back by target personnel. A preferred lachrymatory composition employed comprises orthochlorobenzyl-malononitrile dissolved in N,N-dimethyl formamide or N,N-dimethyl acetamide.

Badgley U.S. Pat. No. 5,161,680 a protective device attachable to outer garment for self protection of a person against criminal attack comprising an easily breakable ampul containing a volatile foul smelling fluid which is emitted through apertures in the body of the device when the ampul is fractured by squeezing said body.

Rosen U.S. Pat. No. 4,848,246 discloses a device for applying a predetermined color coded identification marking onto a perpetrator of a crime. The device is a glove to be worn on the hand of the victim and includes plural color applicators located on respective finger tips of the glove. Each applicator applies a respectively colored dye onto the perpetrator when the applicator is brought into contact with him/her. Thus, a plurality of different colored markings are left on the perpetrator. This can facilitate his/her apprehension and identification.

Pace U.S. Pat. No. 5,208,085 discloses a device for deterring vandalism to exposed exterior surfaces, particularly the exposed surfaces of mailboxes or other receptacles which may be positioned adjacent to roadways. The invention includes a plurality of nodules filled with a mixture including a dye. The nodules are positioned on the exterior surface of the structure to be protected and upon being impacted will propel the dye mixture in a predetermined direction to form a mark on the person performing the vandalism.

Keniston U.S. Pat. No. 5,196,828 discloses a security dye pack disguised as a bundle of currency for deterring robberies which includes a housing formed from a stack of currency bills sewn together and having a hollow chamber formed therein. Canisters containing dye or other active chemicals are secured at opposing ends of the substrate to emit dyed or other active chemicals in opposing directions when expended. The flexible central region of the substrate allows the security dye pack to be bent into a U-shape. Batteries are arranged in a side-by-side relationship in an elongated narrow case to facilitate bending of the security dye pack.

Bouchard et al U.S. Pat. No. 5,156,272 discloses a device for blurring valuable documents such as banknotes including means for delivering a blurring or discoloring liquid to deface banknotes contained within an enclosure upon a breach of security afforded by the enclosure.

Boutroy U.S. Pat. No. 4,799,435 discloses a security device for transporting documents of value such as bank notes, comprising an enclosure having a space for receiving the documents and housing a foam generating unit including a receptacle containing marker liquid adapted to foam up and color documents.

Mareels U.S. Pat. No. 4,722,435 discloses a case for valuable documents, such as notably checks, credit cards, bank notes, etc., comprised of a box with a lid and a closure which may only be opened by inputting a code number, as well as a capsule or phial filled with a pressurized liquid which can destroy or make useless said documents.

Levavasseur U.S. Pat. No. 4,712,489 discloses a physicochemical process for marking and/or destroying valuable documents confined in an enclosure known as a safety enclosure for their conveyance and for their storage, and to the device for making use of it.

Cummins U.S. Pat. No. 4,649,833 discloses a safe security system which includes a dye marking device within the safe and an electrical interlock circuit operating to activate the marking device.

Rosen U.S. Pat. No. 4,610,806 discloses that fluorescamine or like compounds react with the epidermis when applied to the skin and form, within about 15 to 30 minutes after application to the skin, a long-lasting reaction product, which is invisible in ordinary light but which fluoresces intensely under ultraviolet light. Such markings resist removal by abrasion and repeated washings.

Stenild U.S. Pat. No. 4,607,579 discloses a system for marking bank notes or other articles of value in a closed space with a dye at attempts at burglary.

Millar U.S. Pat. No. 4,391,203 discloses a security apparatus having a dye bomb.

Cedergren U.S. Pat. No. 4,273,478 discloses a lockable security container for the transportation of valuables and including dyeing means for damaging valuables positioned within the container on unauthorized tampering.

Grahn U.S. Pat. No. 4,226,194 discloses a method of chemically labeling articles during the course of a theft or robbery and thereby subsequently detecting and identifying both the stolen articles and the thief thereof.

Peters U.S. Pat. No. 3,730,110 discloses a dye release device for marking contents of a cash register drawer when unauthorized removal of such contents is attempted.

Robeson U.S. Pat. No. RE 27,618 (Reissue of U.S. Pat. No. 3,564,525) discloses a robbery protection system and device for temporarily disabling and visibly marking the location of a robber after his departure from the robbed premises and includes a transmitter for emitting an electric field in the proximity of the escape path of the robber, and a dummy packet of currency having concealed therein a disabling and marking charge as well as means for activating said charge upon detection of said electric field.

SUMMARY OF THE INVENTION

A sprayable composition for deterring criminals, e.g., muggers, robbers, rapists, etc., consists essentially of a sprayable lachrymatory agent, such as MACE, admixed with a minor but effective amount of a dye which is substantive for human skin and difficult to remove and a minor but effective amount of a persistent odorant such as oil of skunk (a complex mercaptan), fatty diamines, such as putrescine or cadaverine, or the like. The composition is supplied in a pressurized canister of the type conventionally used for containing and spraying MACE and when sprayed on an attacker repels the attacker and identifies him both by the stain and the smell.

One of the objects of this invention is to provide a new and improved method for deterring and apprehending criminals, e.g., muggers, robbers, rapists, etc.

Another object of this invention is to provide a new and improved method for deterring and apprehending criminals, e.g., muggers, robbers, rapists, etc. which comprises spraying an improved lachrymatory and identifying composition on the criminal.

Another object of this invention is to provide a new and improved method for deterring and apprehending criminals, e.g., muggers, robbers, rapists, etc. which comprises spraying an improved lachrymatory composition containing an identifying composition on the criminal.

Another object of this invention is to provide a new and improved method for deterring and apprehending criminals, e.g., muggers, robbers, rapists, etc. which comprises spraying an improved lachrymatory composition containing an identifying dye composition on the criminal.

Another object of this invention is to provide a new and improved method for deterring and apprehending criminals, e.g., muggers, robbers, rapists, etc. which comprises spraying an improved lachrymatory composition containing an identifying odorant composition on the criminal.

Another object of this invention is to provide a new and improved method for deterring and apprehending criminals, e.g., muggers, robbers, rapists, etc. which comprises spraying an improved lachrymatory composition, such as MACE, containing an identifying dye and odorant composition on the criminal.

Another object of this invention is to provide a new and improved lachrymatory and identifying composition for deterring and apprehending criminals, e.g., muggers, robbers, rapists, etc. by spraying on the criminal.

Another object of this invention is to provide a new and improved lachrymatory and identifying dye composition for deterring and apprehending criminals, e.g., muggers, robbers, rapists, etc. by spraying on the criminal.

Another object of this invention is to provide a new and improved lachrymatory and identifying odorant composition for deterring and apprehending criminals, e.g., muggers, robbers, rapists, etc. by spraying on the criminal.

Another object of this invention is to provide a new and improved lachrymatory composition, such as MACE, containing identifying dye and odorant compositions for deterring and apprehending criminals, e.g., muggers, robbers, rapists, etc. by spraying on the criminal.

Other objects of the invention will become apparent from time to time throughout the specification and claims as hereinafter related.

DESCRIPTION OF THE PREFERRED EMBODIMENTS

This invention relates to a sprayable composition and methods of use thereof, i.e., for spraying on criminals, e.g., muggers, robbers, rapists, etc., to deter and detect crime.

The composition consists essentially of a sprayable lachrymatory agent, such as MACE (chloroacetophenone) or orthochlorobenzylmalononitrile dissolved in N,N-dimethyl formamide or N,N-dimethyl acetamide, or the like, admixed with a minor but effective amount of a dye which is substantive for human skin and difficult to remove and a minor but effective amount of a persistent odorant such as oil of skunk (a complex mercaptan), musk, aliphatic diamines, such as putrescine (tetramethylene diamine) or cadaverine (pentamethylene diamine), or other like persistent strong odorants.

The lachrymatory agent may be any known lachrymatory material which is readily available in sprayable form or which may be compounded or admixed in sprayable form, e.g., as an aerosol. MACE (chloroacetophenone) is readily available for this purpose but other lachrymators (see any standard reference book on lachrymators used as war gases or for riot control) can be used.

A persistent odorant such as oil of skunk (a complex mercaptan), musk, aliphatic diamines, such as putrescine (tetramethylene diamine) or cadaverine (pentamethylene diamine), or other like persistent strong odorants, is added to and admixed with the lachrymatory agent in an amount just sufficient to give a strong, persistent disagreeable odor to a person contacted by it. The amounts which will produce this result are well known and can be easily determined during compounding or mixing. Obviously, larger concentrations can be used, if desired, subject to economic considerations, i.e., use as much as is affordable and effective.

The dye which is used is one which is compatible with the other ingredients and is preferably substantive for the human skin and/or clothing. Suitable dyes have been used in automatic devices and methods of defacing currency in bank bags and currency drawers to render the proceeds or a bank robbery unusable. Dyes of the kind used in security dye packs described in Rosen U.S. Pat. No. 4,848,246, Pace U.S. Pat. No. 5,208,085, Kenisston U.S. Pat. No. 5,196,828, Cummins U.S. Pat. No. 4,649,833, Rosen U.S. Pat. No. 4,610,806, Stenild U.S. Pat. No. 4,607,579, Millar U.S. Pat. No. 4,391,203, Cedergren U.S. Pat. No. 4,273,478, Grahn U.S. Pat. No. 4,226,194, Peters U.S. Pat. No. 3,730,110 and Robeson U.S. Pat. No. RE 27,618 (Reissue of U.S. Pat. No. 3,564,525) are satisfactory. Some of these dyes are visible is ordinary light and some are rendered visible under ultraviolet illumination. The dye is added to and admixed with the lachrymatory agent in an amount just sufficient to give the desired identification to the criminal. The amounts which will produce this result are well known and can be easily determined during compounding or mixing. Obviously, larger concentrations can be used, if desired, subject to economic considerations, i.e., use as much as is affordable and effective.

The composition is supplied in a pressurized canister of the type conventionally used for containing and spraying MACE and when sprayed on an attacker repels the attacker and identifies him both by the stain and the smell. A suitable composition is MACE dispersed in a propellant and pressurized in a canister containing an effective amount of the dye and the odorant in the range from 0.01–20.0% of each, based on the MACE or other lachrymatory agent. The lachrymatory agent/dye/odorant composition may be used and sprayed as compounded or may be diluted with a suitable inactive diluent or propellant.

While this invention has been described fully and completely with special emphasis on certain preferred embodiments, it should be understood that within the scope of the appended claims the invention may be practiced otherwise than as specifically described.

I claim:

1. A method of deterring and apprehending criminals comprising spraying the criminal with a composition consisting essentially of a lachrymatory agent consisting of (a) MACE (chloroacetophenone) or (b) orthochlorobenzyl-malononitrile dissolved in N,N-dimethyl formamide or N,N-dimethyl acetamide and a minor amount of a persistent identifying agent which difficult to remove from the skin or clothing, said identifying agent being a minor but effective amount of a dye, visible in ordinary light, which is substantive for human skin and a minor but effective amount of a persistent odorant.

2. A method according to claim 1 in which said persistent odorant is present in the range from 0.01 to 20.0% based on the lachrymatory agent.

3. A method according to claim 1 in which said persistent odorant is an aliphatic fatty diamine or a mercaptan.

4. A method according to claim 1 in which said persistent odorant is oil of skunk, putrescine or cadaverine.

5. A composition for spraying on criminals for deterring and apprehending them consisting essentially of a lachrymatory agent consisting of (a) MACE (chloroacetophenone) or (b) orthochlorobenzyl-malononitrile dissolved in N,N-dimethyl formamide or N,N-dimethyl acetamide and a minor amount of a persistent identifying agent which difficult to remove from the skin or clothing, said identifying agent is minor but effective amount of a dye, visible in ordinary light, which is substantive for human skin and a minor but effective amount of a persistent odorant.

6. A composition according to claim 5 in which said persistent odorant is present in the range from 0.01 to 20.0% based on the lachrymatory agent.

7. A composition according to claim 5 in which said persistent odorant is an aliphatic fatty diamine or a mercaptan.

8. A composition according to claim 5 in which said persistent odorant is oil of skunk, putrescine or cadaverine.

* * * * *